US006637043B1

(12) United States Patent
Lordahl et al.

(10) Patent No.: US 6,637,043 B1
(45) Date of Patent: Oct. 28, 2003

(54) REPLACEABLE FLUSH VALVE SEAT ASSEMBLY

(75) Inventors: Var Lordahl, 1571 Schaeffer Rd., Long Grove, IL (US) 60047; Scott H. Koepsel, Winthrop Harbor, IL (US)

(73) Assignee: Var Lordahl, Long Grove, IL (US)

( * ) Notice: Subject to any disclaimer, the term of this patent is extended or adjusted under 35 U.S.C. 154(b) by 0 days.

(21) Appl. No.: 10/210,950

(22) Filed: Aug. 5, 2002

(51) Int. Cl.[7] ..... E03D 1/34
(52) U.S. Cl. ..... 4/378
(58) Field of Search ..... 4/378; 277/630

(56) References Cited

U.S. PATENT DOCUMENTS 2,190,147 A * 2/1940 Ciaccio et al. ..... 251/363
2,277,388 A * 3/1942 Clark ..... 251/363
3,988,785 A * 11/1976 Schoepe et al. ..... 251/363
4,471,499 A * 9/1984 Troman et al. ..... 4/393
5,325,547 A * 7/1994 Pino ..... 4/378

* cited by examiner

*Primary Examiner*—Charles E. Phillips
(74) *Attorney, Agent, or Firm*—Kajane McManus

(57) ABSTRACT

The replaceable flush valve seat assembly of the present invention comprises a circular seal which is engaged to and upon a sealing surface of a flush valve body within a tank of a toilet by a seat comprising a ring which fits over the seal and engages a circumferential lip of the flush valve body. Such seat assembly eliminates the need to dismantle a toilet to replace a flush valve body having a worn out seal surface.

3 Claims, 3 Drawing Sheets

FIG. 3
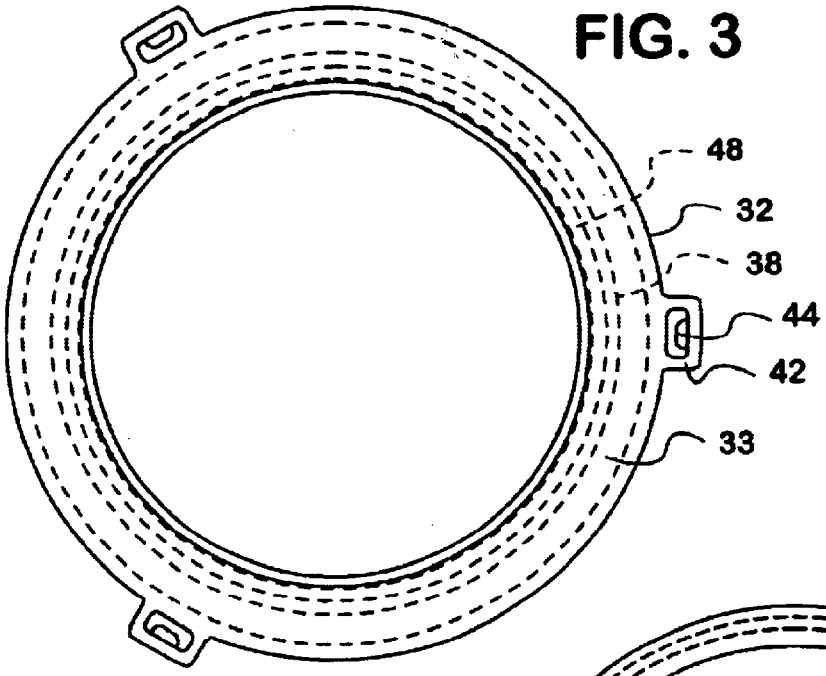
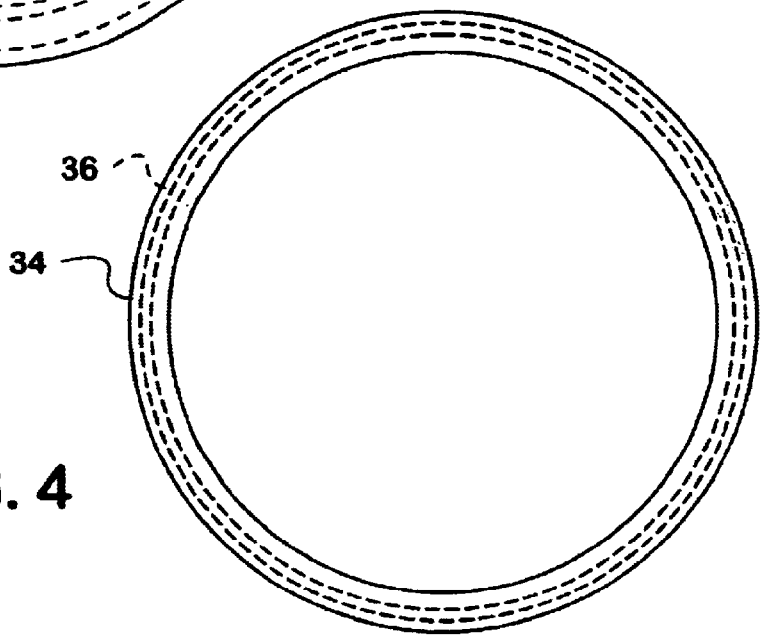
FIG. 4
FIG. 5
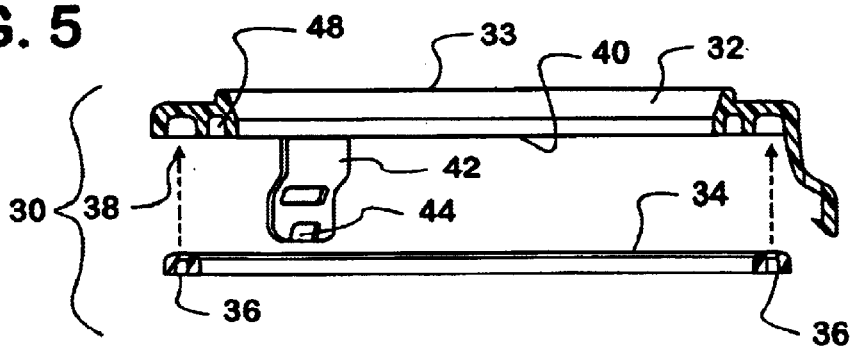

REPLACEABLE FLUSH VALVE SEAT ASSEMBLY

BACKGROUND OF THE INVENTION

1. Field of the Invention

The present invention relates to a replaceable flush valve seat assembly. More particularly, it relates to a replaceable assembly which does not require disassembly of a toilet for replacement thereof.

2. Prior Art

It is known that 95% of toilets are comprised of two sections. The top section comprises a tank and the bottom section comprises a bowl, with the sections being bolted together during construction of the toilet.

The flush valve extends between the two sections and is installed before the tank is engaged over the bowl and bolted thereto.

Thus, when the flush valve eventually fails, such as, for example, when the seat surface develops microscopic cracks, it has heretofore required dismantling of the toilet to replace the flush valve.

Accordingly, there is a need for an easily replaceable flush valve seat which requires no disassembly of the toilet.

SUMMARY OF THE INVENTION

According to the invention there is provided a replaceable flush valve seat assembly which eliminates the need to dismantle a toilet for replacement of a flush valve body having a worn out sealing surface, the flush valve body extending between a tank and a bowl of the toilet, and incorporating a circumferential lip just beneath the sealing surface, the assembly comprising a sealing ring having a groove therein of a diameter equal to a diameter of the sealing surface and a seating ring having at least one groove therein within which the sealing ring is received, the seating ring further including a plurality of downwardly extending arms each having an inwardly extending end flange thereon, the end flange of each arm engaging under the circumferential lip of the flush valve body when positioned over the flush valve body sealing surface, trapping the sealing surface within the groove of the sealing ring and having a top surface which forms the valve seat.

BRIEF DESCRIPTION OF THE DRAWINGS

FIG. 3 is a top plan view of a seat of the assembly.

FIG. 4 is a top plan view of a seal of the assembly.

FIG. 5 is a side view of the assembly with portions broken away.

DESCRIPTION OF THE PREFERRED EMBODIMENTS

Figure 1:
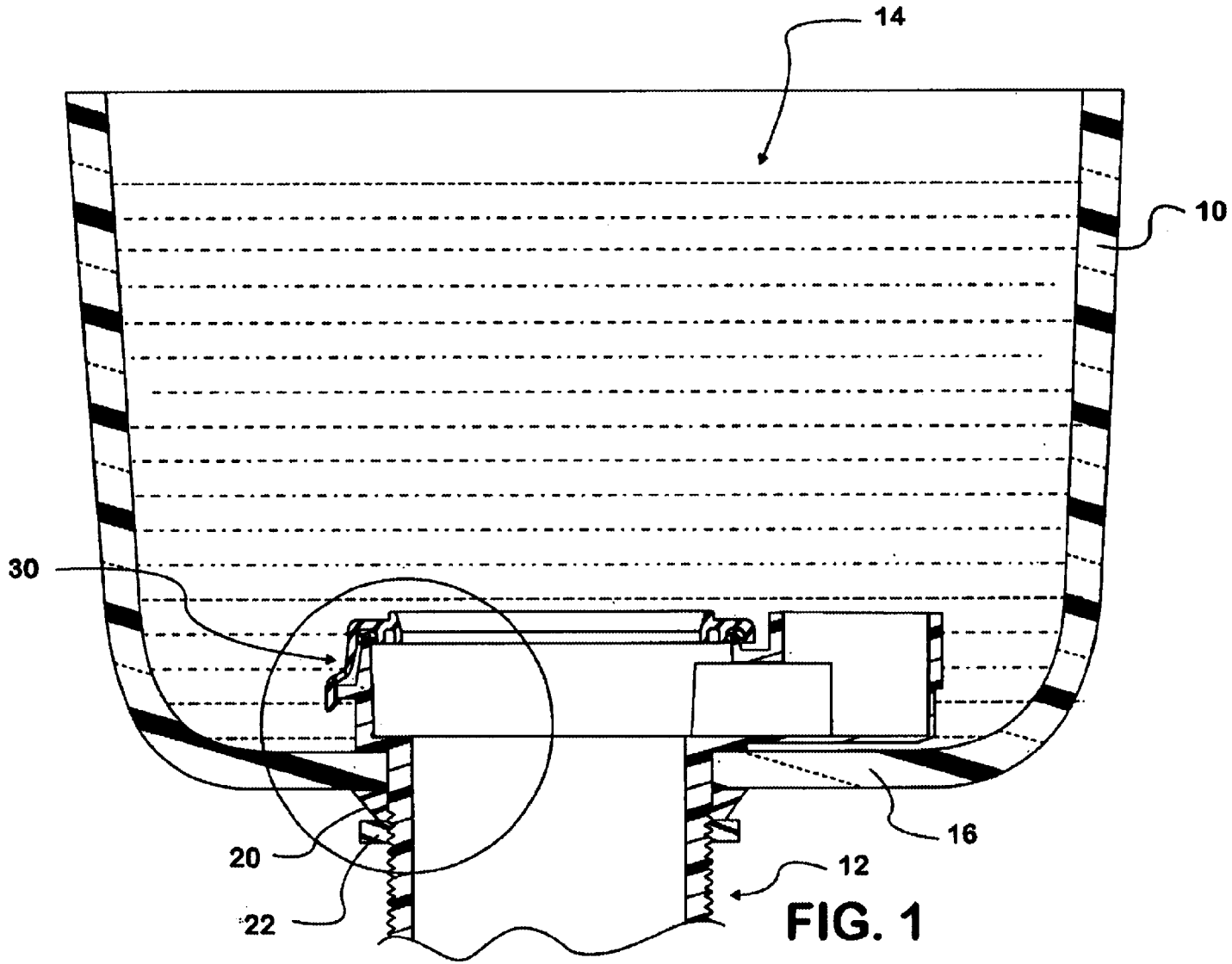
FIG. 1 is a cross sectional view through a toilet showing the replaceable flush valve seat assembly of the present invention positioned within the tank of the toilet.
Figure 2:
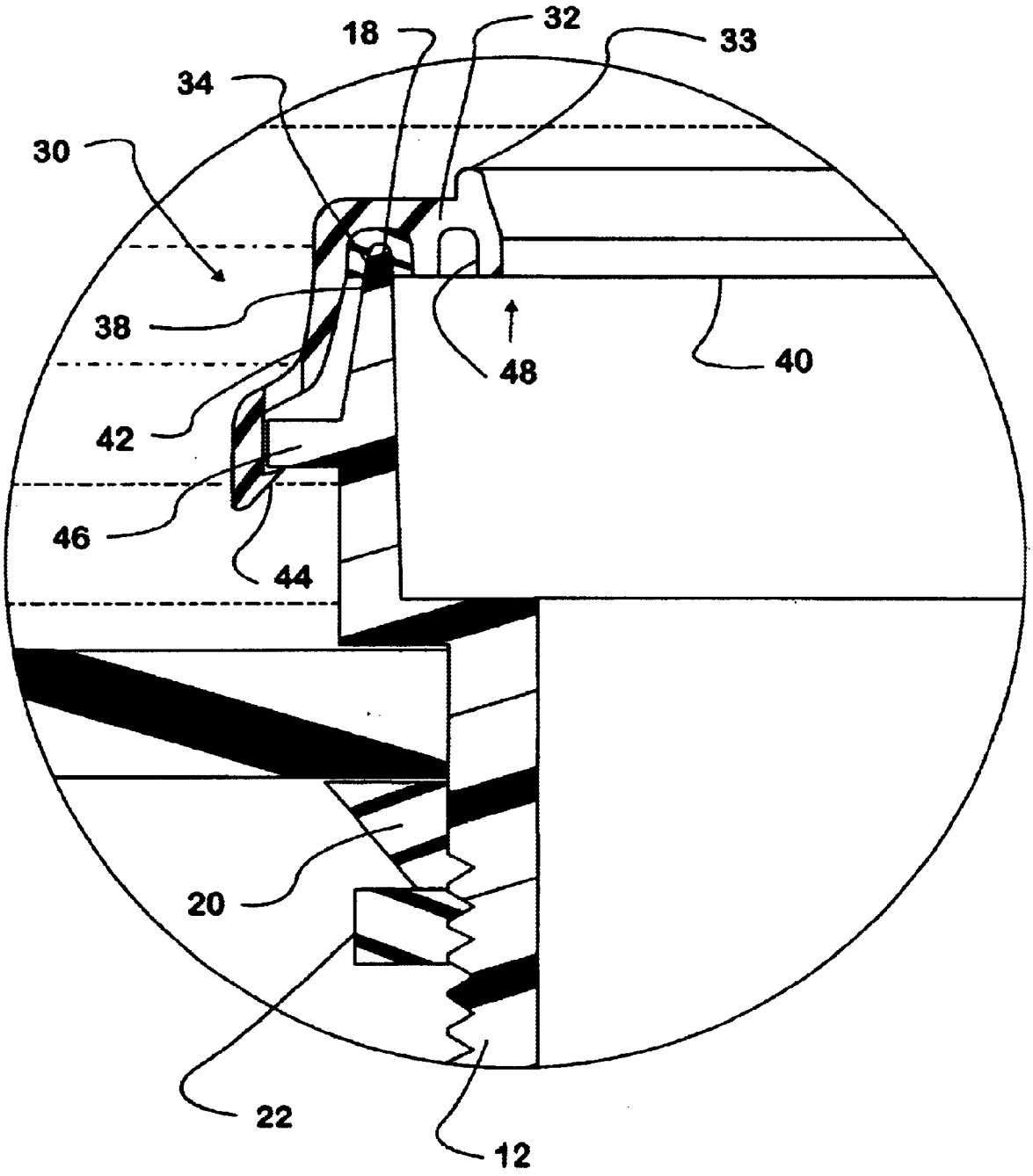
FIG. 2 is an enlarged cross section of the area circled in FIG. 1.

Referring now to the drawings in greater detail, beginning with FIG. 1, there is illustrated therein a cross sectional view through a common toilet tank 10. The tank 10 includes, among other structures, a common flush valve body 12 extending from an interior 14 of the tank, through a bottom wall 16 thereof, so as to appropriately engage an associated toilet bowl (not shown) commonly positioned beneath the tank 10. The flush valve body 12 incorporates a seal surface 18.

Commonly engaged beneath the tank 10 is a flush valve tank seal 20, held in position by a flush valve nut 22.

It will be understood that, when the flush valve seal surface 18 fails, through aging, among other things, in order to replace same, the tank 10 must be disengaged, after disengaging plumbing associated therewith (not shown) to allow for access to the flush valve body 12 for replacement thereof. This is a long, complicated, drawn out and messy procedure.

The procedure can be eliminated through use of the replaceable flush valve seat assembly of the present invention, referred to in toto by reference numeral 30.

As will be best understood from perusal of the Figures the assembly 30 comprises two sections. The first will be referred to herein as a valve seat 32 and the second will be referred to-as a valve seal 34, the two sections cooperating to create the assembly 30.

Beginning with the second section 34, it will be seen to comprise a sealing ring 34 of compressible material, being U shaped in cross section, having a groove 36 therein, which is of a diameter equal to a diameter of the top edge or seal surface 18 of the flush valve body 12 within the tank 10.

When positioned appropriately upon this seal surface 18 of the flush valve body 12, and engaged thereagainst by the first section 32 which comprises a seating ring 32, the flush valve seat assembly 30 is formed.

The seating ring 32 is configured to have a first groove 38 in an underside 40 thereof within which the sealing ring 34 snugly fits. The seating ring 32 further incorporates a plurality of downwardly extending flexible arms 42 each having an inwardly extending end flange 44 thereon, the end flanges 44 engaging beneath a circumferential lip 46 on the flush valve body 12 beneath the sealing surface 18 thereof, in a snap lock manner.

The underside 40 of the seating ring 32 further incorporates a second groove 48 therein, radially interior to the first groove 38. This second groove 48 acts to allow the seating ring 32 to be flexible during installation thereof as well as creating a seating ring 32 of substantially non-varying thickness, substantially eliminating stresses known to exist in parts of varied thickness.

It will be understood that a top surface 33 of the seating ring 32 will form a valve seat 33 when engaged over the seal surface 18.

In use, the sealing ring 34 is placed on the sealing surface 18 of the flush valve body 12 such that the groove 36 of the sealing ring 34 encompasses the seal surface 18 of the flush valve body 12. The seating ring 32 is then pressed on over sealing ring 34, capturing the sealing ring 34 into the first groove 38 of the seating ring 32, and the flexible arms 42 of the seating ring 32 are manipulated until the end flange 44 of each arm 42 engages beneath the lip 46 of the flush valve body 12, securely capturing sealing ring 34 between seating ring 32 and the flush valve body 12, creating the seal assembly 30 which does not require any disassembly of a toilet for removal of a flush valve body 12 having a worn out seal surface 18.

As described above, the replaceable flush valve seat assembly 30 of the present invention provides a number of advantages, some of which have been described above and others of which are inherent in the invention.

Also, modifications may be proposed to the replaceable flush valve seat assembly 30, as well as equivalents, without departing from the teachings of the present invention.

Accordingly, the scope of the invention is only to be limited as necessary by the accompanying claims.

We claim:

1. A replaceable flush valve seat assembly which eliminates the need to dismantle a toilet for replacement of a flush valve body having a worn out sealing surface, the flush valve body extending between a tank and a bowl of the toilet, and incorporating a circumferential lip just beneath the sealing surface, the assembly comprising a sealing ring having a groove therein of a diameter equal to a diameter of the sealing surface and a seating ring having at least one groove therein within which the sealing ring is received, the seating ring further including a plurality of downwardly extending arms each having an inwardly extending end flange thereon, the end flange of each arm engaging under the circumferential lip of the flush valve body when positioned over the flush valve body sealing surface, trapping the sealing surface within the groove of the sealing ring and having a top surface which forms the valve seat.

2. The assembly of claim 1 wherein the sealing ring is compressible.

3. The assembly of claim 1 wherein the seating ring is flexible.

* * * * *